US012158062B2

(12) United States Patent
AlYousif et al.

(10) Patent No.: US 12,158,062 B2
(45) Date of Patent: Dec. 3, 2024

(54) SWEEP EFFICIENCY OF CARBON DIOXIDE GAS INJECTION

(71) Applicant: Saudi Arabian Oil Company, Dhahran (SA)

(72) Inventors: Zuhair Ali AlYousif, Saihat (SA); Subhash Chandrabose Ayirala, Dhahran (SA); Sunil Kokal, Dhahran (SA); Ali Abdallah Al-Yousef, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/073,091

(22) Filed: Dec. 1, 2022

(65) Prior Publication Data

US 2024/0183256 A1 Jun. 6, 2024

(51) Int. Cl.
*E21B 43/16* (2006.01)
*E21B 7/04* (2006.01)

(52) U.S. Cl.
CPC ..... *E21B 43/168* (2013.01); *E21B 7/046* (2013.01); *E21B 43/164* (2013.01)

(58) Field of Classification Search
None
See application file for complete search history.

(56) References Cited

U.S. PATENT DOCUMENTS 3,565,175 A * 2/1971 Wilson ..... C09K 8/588 166/400
4,026,358 A * 5/1977 Allen ..... E21B 43/16 166/402
4,116,275 A * 9/1978 Butler ..... E21B 43/2406 166/57
4,427,067 A * 1/1984 Stone ..... E21B 43/30 166/272.2
4,605,066 A 8/1986 Djabbarah
(Continued)

FOREIGN PATENT DOCUMENTS

CA 1281894 3/1991
CA 2392831 1/2003
(Continued)

OTHER PUBLICATIONS

Robinowitz et al. "Enhanced Oil Recovery by Horizontal Waterflooding" Final Report May 2006, Work Performed Under Contract No. DE-FG26-02NT15452, pp. 1-76 (Year: 2005).*
(Continued)

*Primary Examiner* — Charles R Nold
(74) *Attorney, Agent, or Firm* — Fish & Richardson P.C.

(57) ABSTRACT

Methods and systems for producing oil from a subsurface reservoir include drilling a horizontal production well into the subsurface reservoir and drilling a horizontal injection well into the subsurface reservoir below the horizontal production well. Carbon dioxide and a second gas are mixed to form a gas mixture with a density more than a density of reservoir fluids between the horizontal production well and the horizontal injection well. The gas mixture is injected into the subsurface formation through the horizontal injection well and fluid is produced from the subsurface reservoir through the horizontal production well.

19 Claims, 5 Drawing Sheets

(56) References Cited

U.S. PATENT DOCUMENTS

| | | | | |
|---|---|---|---|---|
| 5,826,656 | A * | 10/1998 | McGuire | E21B 43/20 166/305.1 |
| 2006/0254739 | A1* | 11/2006 | Odmark | D21F 1/80 162/305 |
| 2006/0254769 | A1* | 11/2006 | Wang | E21B 43/16 166/57 |
| 2011/0064439 | A1* | 3/2011 | Suzuki | G03G 15/6573 399/69 |
| 2011/0108369 | A1* | 5/2011 | Stolt | B66B 1/30 318/400.04 |
| 2014/0341755 | A1* | 11/2014 | Laing | F04B 23/04 417/474 |
| 2015/0292303 | A1* | 10/2015 | Dusseault | E21B 41/0064 166/305.1 |
| 2021/0032969 | A1 | 2/2021 | Abu-Khamsin et al. | |

FOREIGN PATENT DOCUMENTS

| | | | |
|---|---|---|---|
| CN | 116066039 | * | 5/2023 |
| DE | 112013007461 | * | 6/2016 |
| GB | 1480675 | | 7/1977 |
| GB | 2272465 | | 7/1996 |
| RU | 2494233 | * | 9/2013 |

OTHER PUBLICATIONS

AlYousef et al., "Direct Thickening of Supercritical Carbon Dioxide Using CO2-Soluble Polymer," presented at the Abu Dhabi International Petroleum Exhibition & Conference, Abu Dhabi, UAE, Nov. 11-14, 2019, 11 pages.

AlYousef et al., "Evaluating foam stability using tailored water chemistry for gas mobility control applications," Journal of Petroleum Science and Engineering, Dec. 2020, 195:107532, 7 pages.

Berg et al., "Miscible displacement of oils by carbon disulfide in porous media: Experiments and analysis," Physics of Fluids, Nov. 2010, 22:113102, 15 pages.

Christensen et al., "Review of WAG Field Experience," presented at the SPE International Petroleum Conference and Exhibition of Mexico, Villahermosa, Mexico, Mar. 3-5, 1998, 14 pages.

De Crisci et al., "Hydrogen from hydrogen sulfide: towards a more sustainable hydrogen economy," International Journal of Hydrogen Energy, Oct. 2018, 44(3):1299-1327, 29 pages.

Merchant, "Life Beyond 80—A look at Conventional WAG Recovery Beyond 80 % HCPV Injection in CO2 Tertiary Floods," presented at the SPE International Conference on CO2 Capture, Storage, and Utilization, New Orleans, Louisiana, Nov. 10-12, 2010, 14 pages.

Rao et al., "Development of Gas Assisted Gravity Drainage (GAGD) Process for Improved Light Oil Recovery," presented at the SPE/DOE Fourteenth Symposium on Improved Oil Recovery, Tulsa, Oklahoma, Apr. 17-21, 2004, 12 pages.

Verma, "Fundamentals of Carbon Dioxide-Enhanced Oil Recovery (CO2-EOR)—A Supporting Document of the Assessment Methodology for Hydrocarbon Recovery Using CO2-EOR Associated with Carbon Sequestration," U.S. Geological Survey Open-File Report 2015-1071, 2015, 24 pages.

Yellig et al., "Determination and Prediction of CO2 Minimum Miscibility Pressures," Journal of Petroleum Technology, Jan. 1980, 32(01):160-168, 11 pages.

Zick, "A Combined Condensing/Vaporizing Mechanism in the Displacement of Oil by Enriched Gases," presented at the 61st Annual SPE Annual Technical Conference and Exhibition of the Society of Petroleum Engineers, New Orleans, Louisiana, Oct. 1986, 11 pages.

* cited by examiner

SWEEP EFFICIENCY OF CARBON DIOXIDE GAS INJECTION

TECHNICAL FIELD

This disclosure relates enhanced oil recovery (EOR), particularly EOR using carbon dioxide gas.

BACKGROUND

Significant amount of oil remained underground following primary and secondary oil production mechanisms. In some instances, improved oil recovery (IOR) and EOR techniques can be implemented to recover additional oil from mature fields. Gas injection, chemical flooding, thermal injection, and low salinity water (LSW) flooding are the common EOR techniques implemented in oil fields.

Due to the ability of miscible gas to recover most of the residual oil in the zones swept by gas, injection of hydrocarbon gases and non-hydrocarbon gases such as carbon dioxide are the widely used EOR approaches in both sandstones and carbonates. Miscible carbon dioxide gas injection is a popular recovery method used for enhanced oil recovery because it can recover substantial amounts of residual oil due to miscibility while also storing significant volumes of carbon dioxide underground to reduce carbon dioxide in the atmosphere.

SUMMARY

This specification describes an approach to providing bottom-up EOR using horizontal injection wells in a subsurface reservoir that contains hydrocarbons that can be extracted economically (i.e., the pay zone). This uses a horizontal injection well at the bottom of the pay zone and a horizontal production well at the top of the pay zone. Carbon disulfide is added to carbon dioxide gas to increase the density of injection fluid and to reduce the multiple-contact miscibility pressure of carbon dioxide gas. carbon disulfide is heavier than water and the addition of carbon disulfide to carbon dioxide at volumetric ratios ranging from 10 to 50% can increase the density of the gas mixture close to that of resident reservoir fluids (e.g., formation water and crude oil). In addition, carbon disulfide is first contact miscible with oil, while carbon dioxide is multiple-contact miscible. The addition of carbon disulfide to carbon dioxide can further reduce the multiple-contact miscibility pressure of the gas mixture.

In one aspect, methods of producing oil from a subsurface reservoir include: drilling a horizontal production well into the subsurface reservoir; drilling a horizontal injection well into the subsurface reservoir below the horizontal production well; mixing carbon dioxide and carbon disulfide to form a gas mixture with a density more than a density of reservoir fluids between the horizontal production well and the horizontal injection well; injecting the gas mixture into the subsurface formation through the horizontal injection well; and producing fluid from the subsurface reservoir through the horizontal production well.

In one aspect, methods of producing oil from a subsurface reservoir include: drilling a horizontal production well into the subsurface reservoir; drilling a horizontal injection well into the subsurface reservoir below the horizontal production well; mixing carbon dioxide and a second gas to form a gas mixture with a density more than a density of reservoir fluids between the horizontal production well and the horizontal injection well; injecting the gas mixture into the subsurface formation through the horizontal injection well; and producing fluid from the subsurface reservoir through the horizontal production well.

These methods can include one or more of the following features.

In some approaches, the density of the gas mixture at reservoir conditions is at least twice the density of carbon dioxide at reservoir conditions.

In some approaches, drilling the horizontal production well into the subsurface reservoir comprises drilling the horizontal production well into an upper 10% of the subsurface reservoir. In some cases, drilling the horizontal injection well into the subsurface reservoir comprises drilling the horizontal injection well into the subsurface reservoir between 50 and 150 feet below the horizontal production well.

In some approaches, methods also include measuring the density of the reservoir fluids before mixing the mixing carbon dioxide and the carbon disulfide.

In some approaches, the density of the gas mixture under reservoir conditions is between 100% and 110% of the density of the reservoir fluids under reservoir conditions.

In some approaches, mixing the carbon dioxide and the carbon disulfide to form the gas mixture comprises adding carbon disulfide and carbon dioxide at volumetric ratios ranging from 10 to 50%.

In some approaches, methods also include injecting unenriched carbon dioxide into the subsurface formation through the horizontal injection well. In some cases, methods also include injecting water into the subsurface formation through the horizontal injection well. In some cases, injecting the gas mixture, the unenriched carbon dioxide, and the water into the subsurface formation through the horizontal injection well includes injecting 0.05 to 0.10 pore volumes of carbon dioxide gas followed by 0.3 to 0.5 pore volumes of the gas mixture followed by 0.05 to 0.10 pore volumes carbon dioxide gas followed by 0.1 to 1.0 pore volumes water.

Due to the increased gas density as a result of the carbon disulfide addition, the injected carbon dioxide enriched with carbon disulfide has better sweep efficiency and displaces more oil from the targeted pay zone than approaches injecting only carbon dioxide. In addition, The bottom-up displacement injection strategy helps further mitigate the gravity override issues encountered during carbon dioxide injection in some other approaches. In particular, this approach helps avoid the gravity override issue caused by the low density and high mobility of injected gas compared with the other fluids in reservoirs. The density of carbon dioxide gas at in-situ reservoir conditions is lower than that of reservoir fluids and, as a result, the gas will override the reservoir fluids by rising at the top of pay zone due to buoyancy of the gas relative to the reservoir fluids. This phenomenon leaves a significant portion of the reservoir unswept by the injected carbon dioxide gas resulting in poor sweep efficiency and low oil recovery. The bottom-up injection of gas with increased gas density as a result of the carbon disulfide addition also helps compensate for reservoir heterogeneity such as high permeability streaks and fractures that contribute to this issue.

The approach described in this specification can have advantages relative earlier attempts to control the mobility of carbon dioxide and, eventually, mitigate the gravity override issue. This approach does not require any water in contrast to water-alternating-gas (WAG) strategies which requires large amounts of water. In addition, WAG involves injection of regular carbon dioxide so gravity override still will be an issue.

This approach can avoid gravity override issues associated carbon dioxide foam use of carbon dioxide thickener-based approaches. It can also be cheaper than carbon dioxide foam approaches which require foamers, such as costly surfactants. In addition, this approach is better suited for high pressure, high temperature and high salinity environments where foam generation and stabilization can be an issue.

In addition, carbon disulfide is first contact miscible with oil, while carbon dioxide is multiple-contact miscible. The addition of carbon disulfide to carbon dioxide can further reduce the multiple-contact miscibility pressure of the gas mixture. A condition of two fluids that are miscible that is, they form a single phase when mixed in any proportion when first brought into contact at a given pressure and temperature. In reservoir gas flooding, the injected gas composition, oil composition, temperature, and the injection pressure determine the condition of first-contact miscibility. In contrast, fluids that develop miscibility after exchanging components have multiple-contact miscibility. The efficiency of fluid to displace the hydrocarbon is excellent when this fluid forms a first-contact miscibility with the hydrocarbon. In general, higher oil recovery is expected when the injected fluid forms fist-contact miscibility rather than multiple-contact miscibility.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

This specification describes an approach to providing bottom-up EOR using horizontal injection wells. This approach uses a horizontal injection well at the bottom of the pay zone and a horizontal production well at the top of the pay zone. Carbon disulfide is added to carbon dioxide gas to increase the density of injection fluid and to reduce the multiple-contact miscibility pressure of carbon dioxide gas. Carbon disulfide is heavier than water and the addition of carbon disulfide to carbon dioxide at volumetric ratios ranging from 10 to 50% can increase the density of the gas mixture close to that of resident reservoir fluids (e.g., formation water and crude oil). In addition, carbon disulfide is first contact miscible with oil, while carbon dioxide is multiple-contact miscible. The addition of carbon disulfide to carbon dioxide can further reduce the multiple-contact miscibility pressure of the gas mixture.

Figure 1:
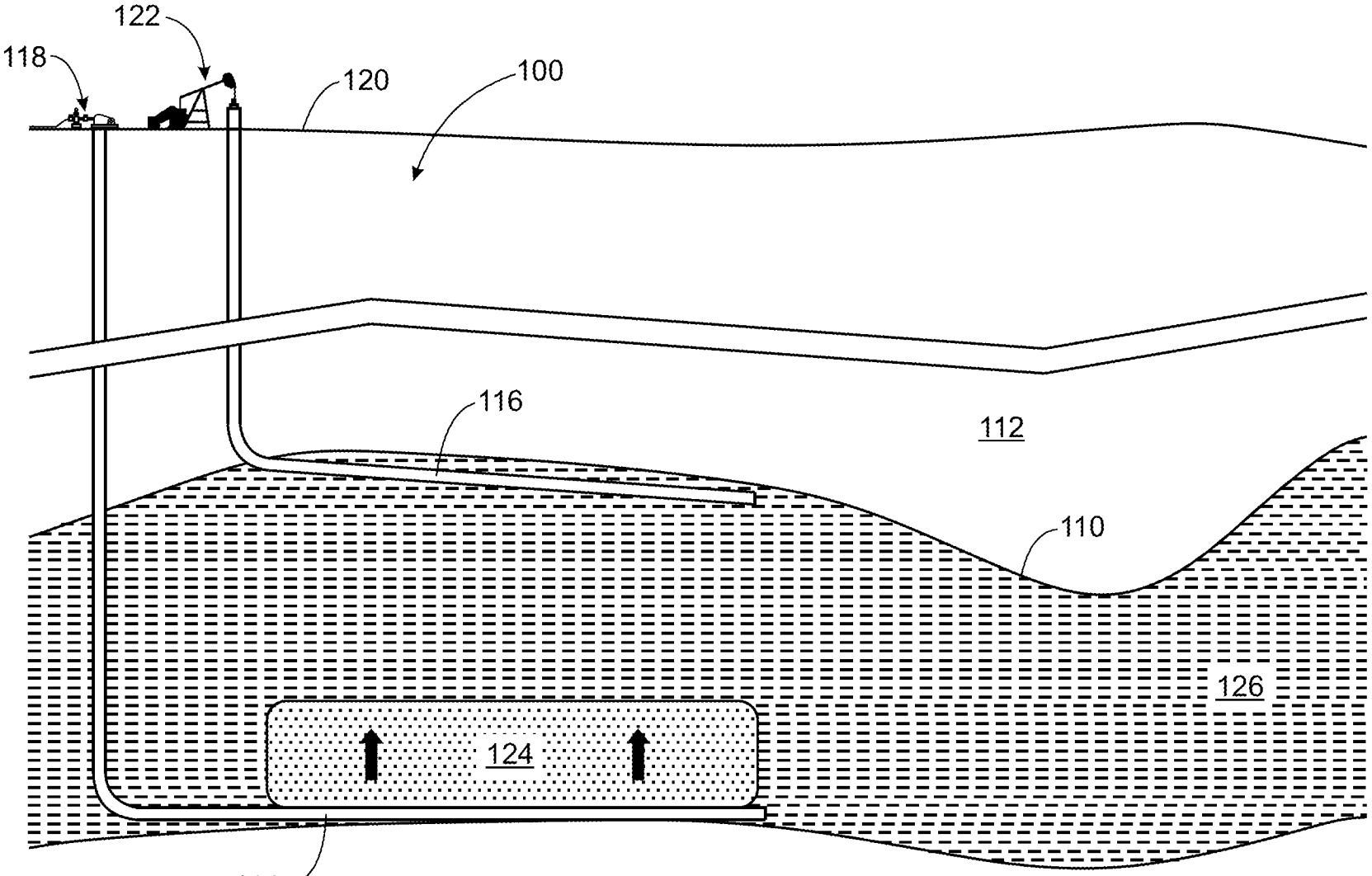
FIG. 1 illustrates a system implementing an EOR approach using horizontal wells.

FIG. 1 illustrates a system 100 implementing an EOR approach using horizontal wells extending into a subsurface formation including a pay zone 110 lying under cap rocks 112 limiting the vertical migration of fluids. The system 100 includes a injection well 114 (e.g., a horizontal injection well) extending laterally at the bottom of the pay zone and a production well 116 (e.g., a horizontal production well) extending laterally at the top of the pay zone. The pay zone thickness is typically 100-1500 feet and the length of the horizontal lateral is typically 100-1000 ft.] An injection system 118 located at the surface 120 near the wellhead of the injection well 114 is operable to inject gas into the pay zone 110. A pump 122 located at the surface 120 near the wellhead of the production well 116 is operable to pump fluids out of the pay zone 110.

This specification uses the term "horizontal well" to indicate a well that deviates significantly from the near-surface orientation of the wellbore to extend laterally within a subsurface formation rather than across the formation. For example, as used in the oil and gas field, both the injection well 114 and the production well 116 would be referred to as horizontal wells even though the production well 160 extends into the pay zone 110 at an angle relative to horizontal rather than being horizontal in an absolute sense.

The gas 124 flowing from injection well 114 displaces the reservoir fluids 126 upwards aided by pumping from the production well 116. The flow of carbon dioxide will be determined by the variation in vertical and horizontal permeability. Based on the ratio of the two permeabilities, the carbon dioxide will move inside the formation. In addition to this, the gravity forces will also impact the movement of carbon dioxide in the upward direction. The thickness pf pay zone might be less thick at the top, but this is not necessary. The movement of fluids inside the formation depends on, viscous forces, capillary forces and gravity forces.]. The gas 124 being injected is selected and/or formulated to be denser under reservoir conditions than the reservoir fluids 126 being produced. For example, carbon dioxide can be mixed with carbon disulfide to form a gas mixture with a density more than a density of reservoir fluids between the injection well 114 and the production well.

The gases including carbon dioxide, natural gas, and nitrogen are used for miscible flooding during EOR. Miscible flooding is a general term for injection processes that introduce miscible gases into the reservoir. Miscible displacement processes maintain reservoir pressure and improves oil displacement because the interfacial tension between oil and gas is reduced. Mobility ratio and miscibility are two parameters that significantly impact governs the oil recovery performance of carbon dioxide gas injection processes. The mobility ratio is the mobility of an injectant divided by that of the fluid it is displacing, such as oil. The mobility of the oil is defined ahead of the displacement front while that of the injectant is defined behind the displacement front, so the respective effective permeability values are evaluated at different saturations. Miscibility characterizes the extent to which two fluids combine to form a single phase when they are brought into contact with each other. The approach described in this specification enriches, for example, carbon dioxide with carbon disulfide to provide a mixed gas whose mobility ratio and miscibility are better for EOR than unenriched carbon dioxide. The term "unenriched carbon dioxide" is used to indicate carbon dioxide that has not purposefully mixed with another gas to change its density and/or miscibility. The carbon dioxide used for EOR is often produced from naturally occurring underground carbon dioxide or as a byproduct of other processes so may not be pure carbon dioxide.

Carbon dioxide is frequently used for gas injection or miscible flooding because it reduces the oil viscosity and is less expensive than liquefied petroleum gas. However, unenriched carbon dioxide has an unfavorable mobility ratio as a result of the low density and viscosity of carbon dioxide compared with the other fluids in reservoirs. This unfavorable mobility ratio leads to viscous fingering, gravity override, and consequently a poor sweep efficiency. Although carbon dioxide is a super critical fluid at reservoir conditions, its density is much lower than the density of resident fluids present in the reservoir (e.g., formation water and crude oil).

Figure 2:
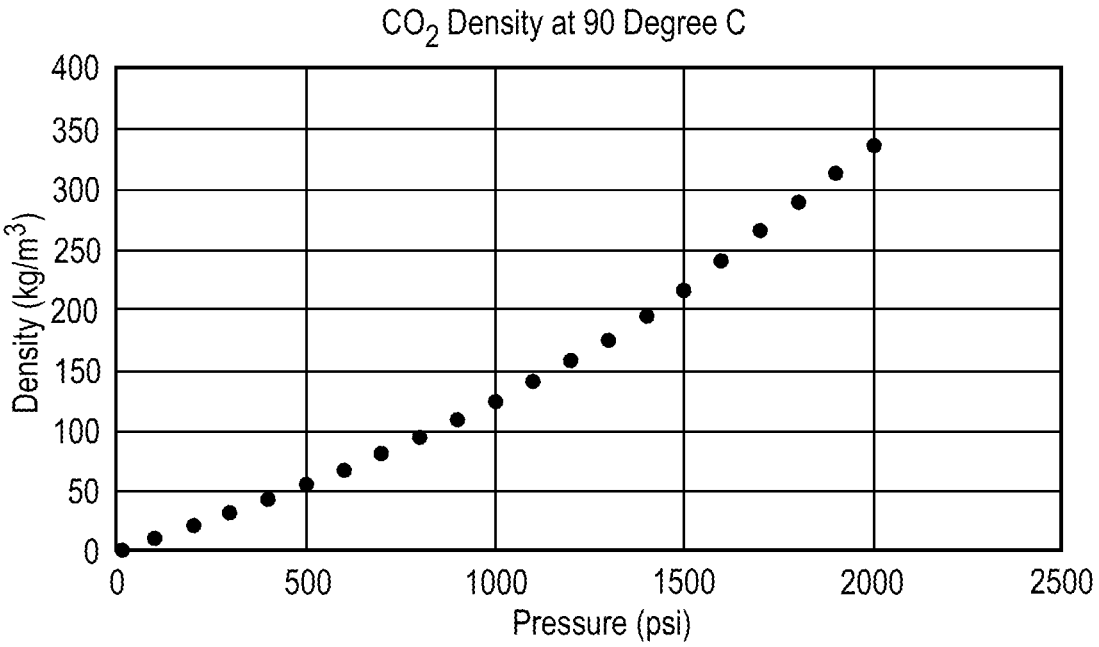
FIG. 2 is a chart plotting carbon dioxide density at 90° C. as a function of pressure.

FIG. 2 is a chart plotting carbon dioxide density at 90° C. as a function of pressure. The gas phase properties of carbon dioxide at 0° C. and 14.7 psia include a specific gravity of 1.54 (1.54 times heavier than air) and a density of 1.98 $kg/m^3$. Carbon dioxide has a critical pressure and temperature of 1,070.6 psia and 31.1° C., respectively. At higher than critical pressures and temperatures, carbon dioxide becomes a supercritical fluid. At 90° C. temperature and 1500 psi, the density of carbon dioxide is 217 $kg/m^3$. Even though the density is increased at higher pressures and temperatures, it is still significantly lower than density of water (960 $kg/m^3$) and typical light crude oil (800 $kg/m^3$) at the same conditions. The significant density contrast between carbon dioxide and resident formation fluids will trigger gravity override of carbon dioxide gas to the top of the pay zone. This gravity override phenomena can result in early breakthrough of gas, poor sweep efficiency, lower oil recovery, and much larger utilization of carbon dioxide gas per barrel of oil recovered.

Figure 3:
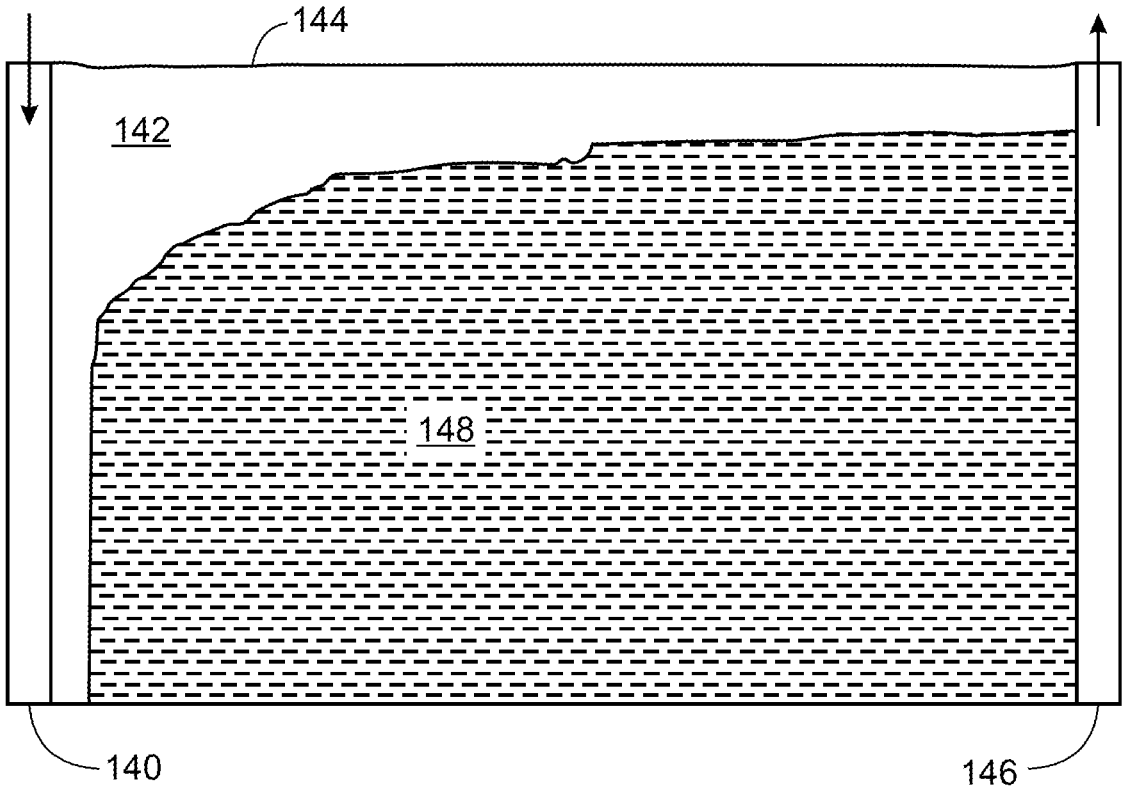
FIG. 3 is a schematic illustrating gravity override of carbon dioxide due to density contrast between carbon dioxide and reservoir fluids at reservoir conditions

FIG. 3 is a schematic illustrating gravity override of carbon dioxide due to density contrast between carbon dioxide and reservoir fluids at reservoir conditions. A vertical injection well 140 is being used to inject carbon dioxide 142 into a pay zone 144 while a vertical production well 146 is being used to produce fluids from the pay zone 144. Because the density of carbon dioxide gas at in-situ reservoir conditions is lower than that of reservoir fluids 148, the carbon dioxide 142 override the reservoir fluids 148 by rising at the top of pay zone due to buoyancy of the carbon dioxide 142 relative to the reservoir fluids 148. This phenomenon leaves a significant portion of the reservoir unswept by the injected carbon dioxide 142 resulting in poor sweep efficiency and low oil recovery. In most cases, simulation results suggest vertical wells over horizontal wells when considering carbon dioxide injection in view of the higher cost of drilling horizontal wells and the impact of the ratio of vertical to horizontal permeability as a controlling parameter.

Figure 4:
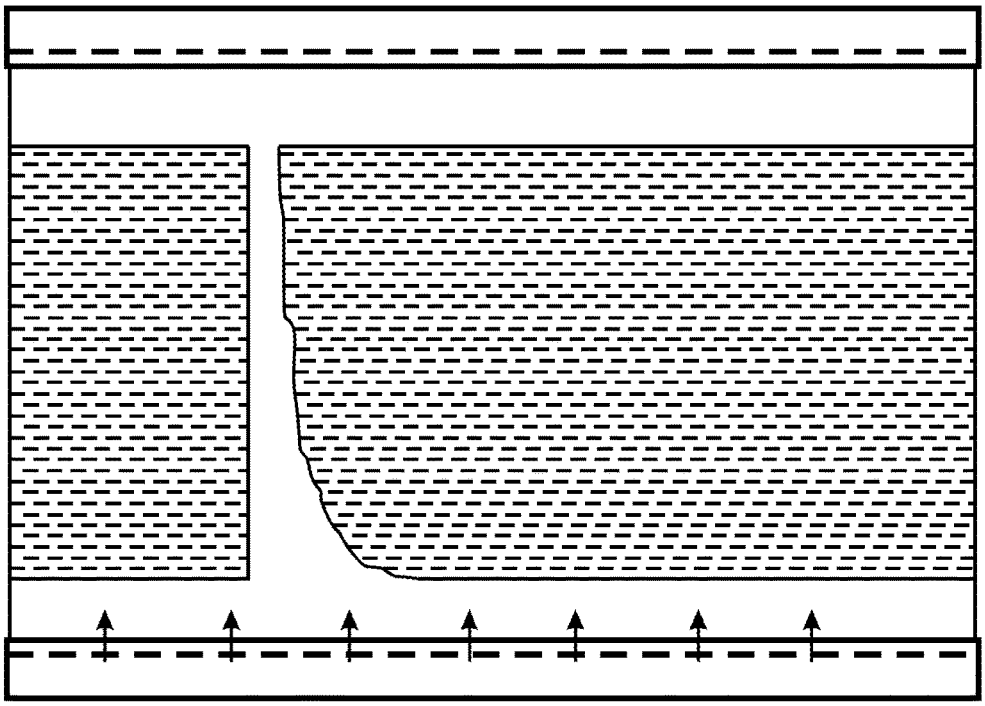
FIG. 4 is a schematic illustrating unenriched carbon dioxide injected using horizontal wells.

FIG. 4 is a schematic illustrating unenriched carbon dioxide injected using horizontal wells. The carbon dioxide will quickly moves to the top layers and bypass the hydrocarbons, especially if there is connected fractures or vertical permeability is higher than horizontal permeability.

Figure 5:
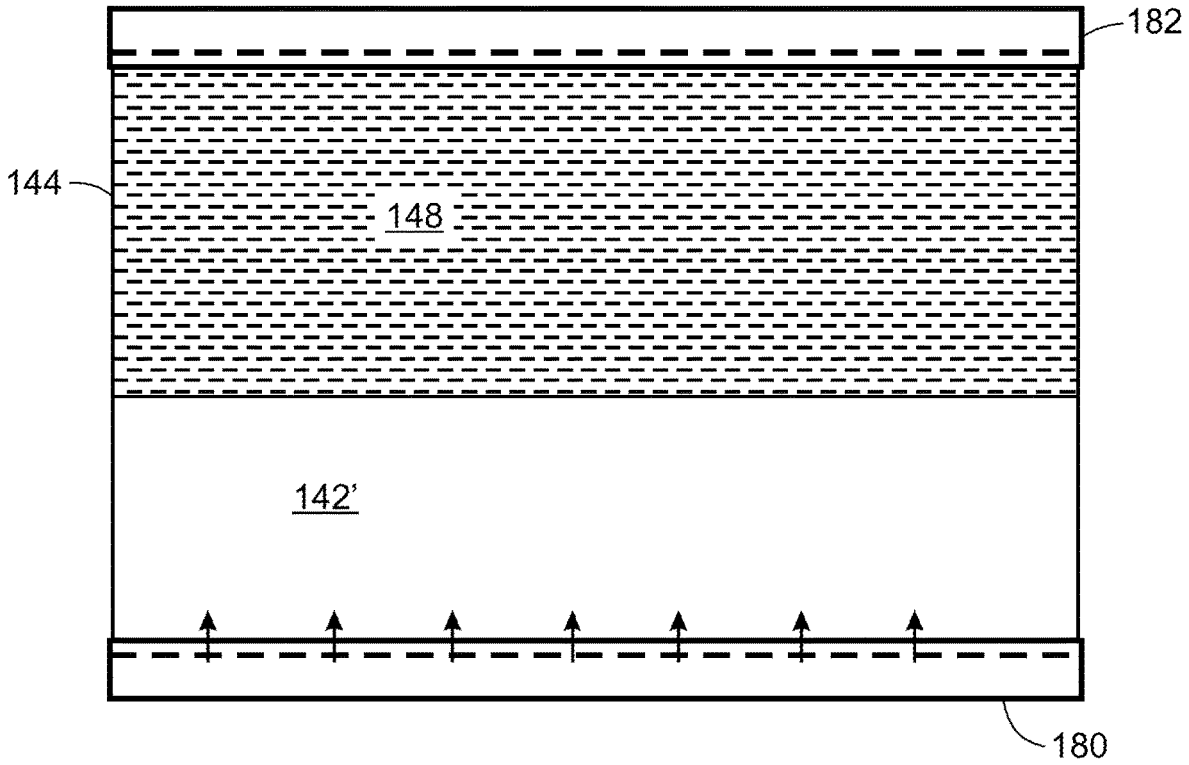
FIG. 5 is a schematic illustrating the uniform sweep of carbon dioxide and carbon disulfide due to reduced density contrast between injection and reservoir fluids at reservoir conditions.

FIG. 5 is a schematic illustrating the uniform sweep of carbon dioxide and carbon disulfide due to reduced density contrast between injection and reservoir fluids at reservoir conditions. A horizontal injection well 180 is being used to inject carbon dioxide enriched with carbon disulfide 142' into the pay zone 144 while a horizontal production well 182 is being used to produce fluids from the pay zone 144. Due to the increase of the density of the carbon dioxide-carbon disulfide mixture, the injected enriched carbon dioxide 142' will have better sweep efficiency and will displace more oil from the targeted pay zone relative the approaches illustrated in FIGS. 3 and 4 when compared to that of injecting only carbon dioxide.

Another challenge in using unenriched carbon dioxide for EOR is that unenriched carbon dioxide exhibits multiple-contact miscibility rather than single contact miscibility. Multiple-contact miscibility is a dynamic fluid-mixing process in which the injected gas exchanges components with in situ oil until the phases achieve a state of miscibility within the mixing zone of the flood front. In a vaporizing drive, light and intermediate components from the oil phase enter the gas phase. By contrast, in a condensing drive, intermediate components from the gas phase enter the oil phase. The process may be a combination of vaporizing and condensing drives.

The interface between gas and oil phases vanishes at miscible conditions to result in a zero gas-oil interfacial tension with one phase. The pressure at which miscible conditions occur is termed as the minimum miscibility pressure (MMP). At pressures above MMP, theoretically carbon dioxide mobilizes most of the residual oil (greater than 90%) in the swept regions. Typically MMP is determined as the pressure at which an oil recovery of at least 90 percent is achieved at the injection of 1.2 HCPV (hydrocarbon pore volume) of carbon dioxide (Yellig and Metcalfe, 1980).

Figure 6:
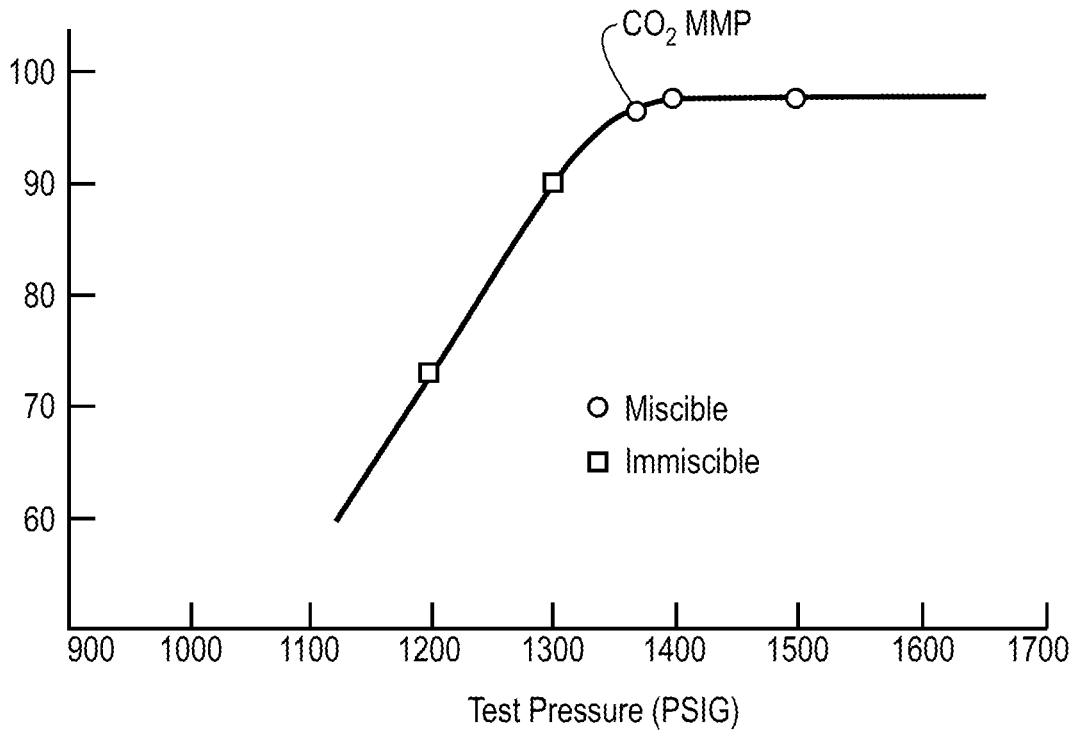
FIG. 6 is a chart plotting percent recovery at 1.2 hydrocarbon pore volume of carbon dioxide injected as a function pressure.

FIG. 6 is a chart plotting percent recovery at 1.2 hydrocarbon pore volume of carbon dioxide injected as a function pressure. The oil recovery increases with pressure until MMP is reached and then becomes almost constant at pressures above the MMP as shown in. Carbon dioxide is not miscible with crude oil at the first contact. Rather it develops miscibility with multiple contacts in the reservoir due to mass transfer interactions between crude oil and carbon dioxide through a combined vaporizing and condensing drive mechanism (Zick, 1986). In the so-called combined vaporizing/condensing drive mechanism, the intermediate to higher molecular weight hydrocarbons from the reservoir oil vaporize into the carbon dioxide (vaporizing gas-drive process) whereas some of the injected carbon dioxide dissolves into the oil (condensing gas-drive process) to develop multiple-contact miscibility between oil and carbon dioxide gas (Merchant, 2010).

To improve its effectiveness for use with the approach described in this specification, it is desirable to mix carbon dioxide with a gas that is heavier than reservoir fluids including water and which is first contact miscible with crude oils. Carbon disulfide is a non-polar solvent that has a density of 1260 $kg/m^3$ (i.e., it is heavier than water). Carbon disulfide is also first contact miscible with reservoir crude oils. Therefore, carbon disulfide mixes with reservoir oil in all proportions by the first contact without needing either prolonged contact or multiple contacts. The addition of carbon disulfide to supercritical carbon dioxide can increase the density of carbon dioxide to attest the gravity override phenomena in the reservoir as shown in FIG. 5. The enhanced miscibility characteristics associated with carbon disulfide also lowers the minimum miscibility pressure of carbon dioxide gas. As a result, carbon disulfide addition to carbon dioxide can be tailored to raise the density of carbon dioxide close to that of water and crude oil in addition to lowering the miscibility pressure of carbon dioxide gas such that it becomes miscible with crude oil at the specific reservoir conditions.

Although other gases with the appropriate characteristics can be used to enrich the carbon dioxide, one potential way to generate carbon disulfide includes direct reformation of sour natural gas ($CH_4$+$H_2S$) produced from oil fields. Such reformation of $H_2S$ and $CH_4$ mixtures can generate 2 moles of $H_2$ and 0.5 mole of carbon disulfide ($CS_2$) per every 1 mole of $H_2S$ reacted with 0.5 mole of CH+, as shown in Eq. 1 below.

$$2H_2S+CH^4 \rightarrow 4H_2+CS_2 \quad \text{Eq. (1)}$$

This reformation process is attractive as it generates clean energy fuel ($H_2$) from the waste sour natural gas. However it is expensive as it consumes significant amounts of energy due to much higher temperatures above 1200° K required for the reformation (De Crisci et al., 2019). The development of commercial market for carbon disulfide as EOR additive for carbon dioxide miscible gas injection processes can also improve the economic viability of H2S—CH4 reformation process for producing clean energy fuel H2.

Figure 7:
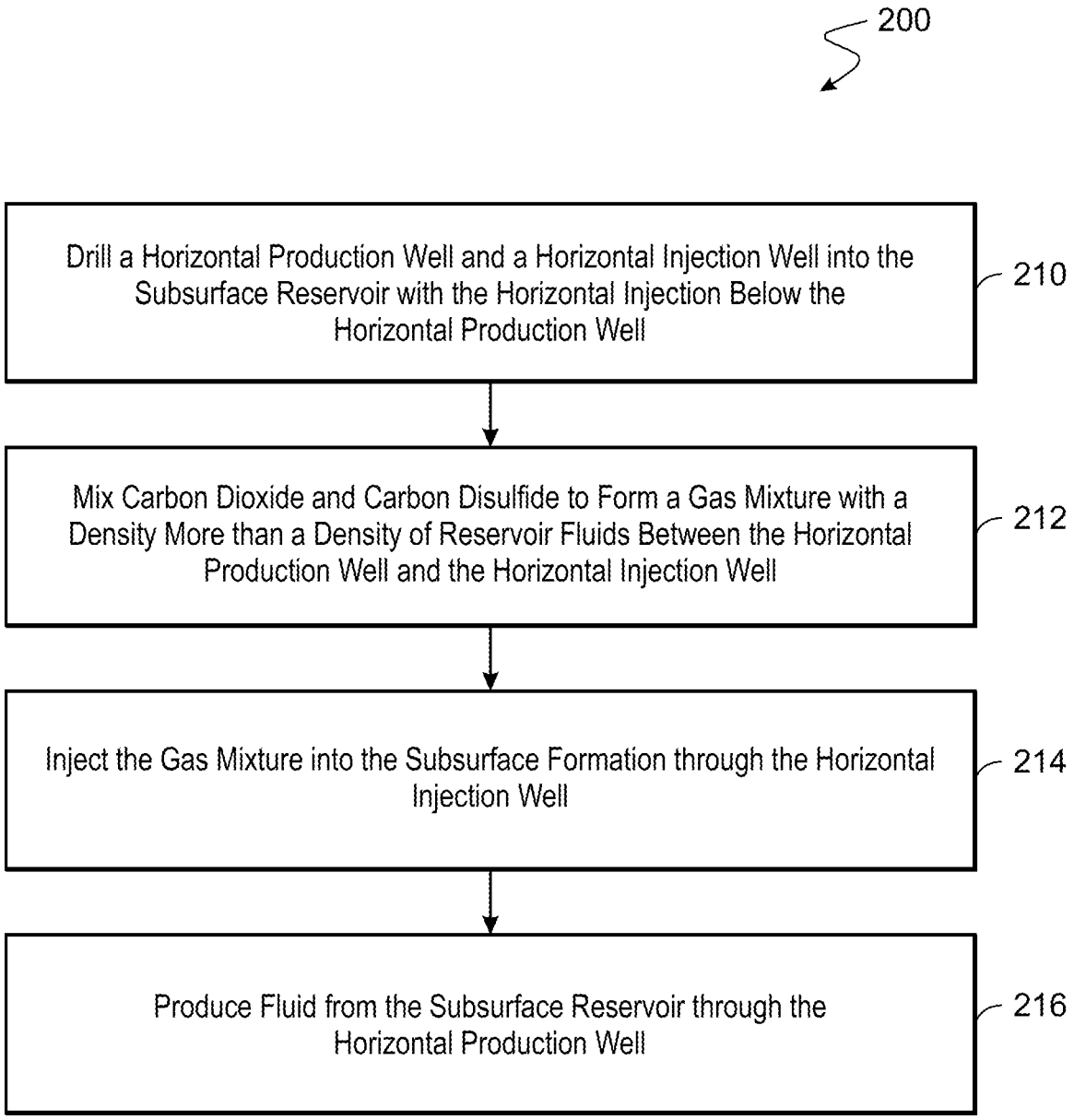
FIG. 7 is a flowchart of a method implementing EOR.

FIG. 7 is a flowchart of a method 200 for implementing EOR to produce oil from a subsurface reservoir. As discussed above, a horizontal production well and a horizontal injection well are drilled into the subsurface reservoir with the horizontal injection below the horizontal production well (step 210). As illustrated in FIG. 1, the production well 116 is located near the top of the subsurface reservoir containing the hydrocarbons being produced. For example, some implementations include a horizontal production well drilled into an upper 10% of the subsurface reservoir. The selection of the production well depends on the simulation results. For example, positioning the well at the top portion of the reservoir can be within few meters from the sealing formation. In addition, the location of the horizontal injection well relative to the horizontal production well impacts both the effectiveness of the EOR and the area covered. For example, some implementations include a horizontal injection well drilled into the subsurface reservoir between tens to hundreds of feet below the horizontal production well.

Carbon dioxide and carbon disulfide are mixed to form a gas mixture with a density more than a density of reservoir fluids between the horizontal production well and the horizontal injection well (step 212). Typically, the gases are mixed on an ongoing basis during EOR. Sometimes the density of the reservoir fluids are measured before mixing the mixing carbon dioxide and the carbon disulfide. However, sometimes the gases are mixed to achieve a density slightly greater than the density of water. In some cases, the density of the gas mixture under reservoir conditions is between 100% and 110% of the density of the reservoir fluids under reservoir conditions. For example, mixing the carbon dioxide and the carbon disulfide to form the gas mixture can include adding carbon disulfide and carbon dioxide at volumetric ratios ranging from 10 to 50%. The density should be at least twice the carbon dioxide density at reservoir conditions. This can be adjusted by changing the carbon disulfide/carbon dioxide ratio.

After mixing, the gas mixture is injected into the subsurface formation through the horizontal injection well (step 214). Although the gas mixture may be the only fluid injected, injection of the gas mixture may be preceded by or followed by the injection of other fluids (e.g., unenriched carbon dioxide and/or water). For example, slugs the gas mixture, unenriched carbon dioxide, and water could be injected into the subsurface formation through the horizontal injection well with 0.05 to 0.10 pore volumes of carbon dioxide gas followed by 0.3 to 0.5 pore volumes of the gas mixture followed by 0.05 to 0.10 pore volumes carbon dioxide gas followed by 0.1 to 1.0 pore volumes water.

A number of embodiments of the invention have been described. Nevertheless, it will be understood that various modifications may be made without departing from the spirit and scope of the invention. Accordingly, other embodiments are within the scope of the following claims.

What is claimed is:

1. A method of producing oil from a subsurface reservoir, the method comprising:

drilling a horizontal production well into the subsurface reservoir;

drilling a horizontal injection well into the subsurface reservoir below the horizontal production well;

mixing carbon dioxide and carbon disulfide to form a gas mixture with a density more than a density of reservoir fluids between the horizontal production well and the horizontal injection well;

injecting the gas mixture into the subsurface formation through the horizontal injection well; and producing fluid from the subsurface reservoir through the horizontal production well.

2. The method of claim 1, wherein drilling the horizontal production well into the subsurface reservoir comprises drilling the horizontal production well into an upper 10% of the subsurface reservoir.

3. The method of claim 2, wherein drilling the horizontal injection well into the subsurface reservoir comprises drilling the horizontal injection well into the subsurface reservoir between 50 and 150 feet below the horizontal production well.

4. The method of claim 1, further comprising measuring the density of the reservoir fluids before mixing the mixing carbon dioxide and the carbon disulfide.

5. The method of claim 1, wherein the density of the gas mixture under reservoir conditions is between 100% and 110% of the density of the reservoir fluids under reservoir conditions.

6. The method of claim 1, wherein mixing the carbon dioxide and the carbon disulfide to form the gas mixture comprises adding carbon disulfide and carbon dioxide at volumetric ratios ranging from 10 to 50%.

7. The method of claim 1, further comprising injecting unenriched carbon dioxide into the subsurface formation through the horizontal injection well.

8. The method of claim 7, further comprising injecting water into the subsurface formation through the horizontal injection well.

9. The method of claim 8, wherein injecting the gas mixture, the unenriched carbon dioxide, and the water into the subsurface formation through the horizontal injection well comprises injecting 0.05 to 0.10 pore volumes of carbon dioxide gas followed by 0.3 to 0.5 pore volumes of the gas mixture followed by 0.05 to 0.10 pore volumes carbon dioxide gas followed by 0.1 to 1.0 pore volumes water.

10. A method of producing oil from a subsurface reservoir, the method comprising:

drilling a horizontal production well into the subsurface reservoir;

drilling a horizontal injection well into the subsurface reservoir below the horizontal production well;

mixing carbon dioxide and a second gas to form a gas mixture with a density more than a density of reservoir fluids between the horizontal production well and the horizontal injection well;

injecting the gas mixture into the subsurface formation through the horizontal injection well; and producing fluid from the subsurface reservoir through the horizontal production well.

11. The method of claim 10, wherein the density of the gas mixture at reservoir conditions is at least twice the density of carbon dioxide at reservoir conditions.

12. The method of claim 11, wherein drilling the horizontal production well into the subsurface reservoir comprises drilling the horizontal production well into an upper 10% of the subsurface reservoir.

13. The method of claim 12, wherein drilling the horizontal injection well into the subsurface reservoir comprises drilling the horizontal injection well into the subsurface reservoir between 50 and 150 feet below the horizontal production well.

14. The method of claim 10, further comprising measuring the density of the reservoir fluids before mixing the mixing carbon dioxide and the carbon disulfide.

15. The method of claim 14, wherein the density of the gas mixture under reservoir conditions is between 100% and 110% of the density of the reservoir fluids under reservoir conditions.

16. The method of claim 10, wherein mixing the carbon dioxide and the carbon disulfide to form the gas mixture comprises adding carbon disulfide and carbon dioxide at volumetric ratios ranging from 10 to 50%.

17. The method of claim 10, further comprising injecting unenriched carbon dioxide into the subsurface formation through the horizontal injection well.

18. The method of claim 17, further comprising injecting water into the subsurface formation through the horizontal injection well.

19. The method of claim 18, wherein injecting the gas mixture, the unenriched carbon dioxide, and the water into the subsurface formation through the horizontal injection well comprises injecting 0.05 to 0.10 pore volumes of carbon dioxide gas followed by 0.3 to 0.5 pore volumes of the gas mixture followed by 0.05 to 0.10 pore volumes carbon dioxide gas followed by 0.1 to 1.0 pore volumes water.

* * * * *